US005952569A

United States Patent [19]

Jervis et al.

[11] Patent Number: 5,952,569

[45] Date of Patent: Sep. 14, 1999

[54] ALARM SYSTEM FOR WELLBORE SITE

[75] Inventors: Timothy Tristam Jervis, Waterbeach; Stuart Inglis Jardine, Cambridge, both of United Kingdom

[73] Assignee: Schlumberger Technology Corporation, Sugar Land, Tex.

[21] Appl. No.: 08/953,897

[22] Filed: Oct. 20, 1997

[30] Foreign Application Priority Data

Oct. 21, 1996 [GB] United Kingdom ..... 9621871

[51] Int. Cl.[6] ..... E21B 49/00; E21B 44/00; G01V 1/40; H04H 9/00

[52] U.S. Cl. ..... 73/152.01; 73/152.46; 175/50; 364/185; 166/250.01

[58] Field of Search ..... 73/152.01, 152.46, 73/152.54; 166/250.01, 363, 364; 175/40, 45, 48, 50; 364/185, 422, 553, 554

[56] References Cited

U.S. PATENT DOCUMENTS

| | | | |
|---|---|---|---|
| 4,507,735 | 3/1985 | Moorehead et al. | 364/422 |
| 4,649,388 | 3/1987 | Atlas | 342/26 |
| 4,802,143 | 1/1989 | Smith | 367/82 |
| 4,876,886 | 10/1989 | Bible et al. | 73/151.5 |
| 5,222,048 | 6/1993 | Grosso et al. | 367/32 |
| 5,303,328 | 4/1994 | Masui et al. | 395/23 |
| 5,416,750 | 5/1995 | Doyen et al. | 367/73 |
| 5,454,436 | 10/1995 | Jardine et al. | 175/40 |
| 5,465,321 | 11/1995 | Smyth et al. | 395/22 |
| 5,469,369 | 11/1995 | Rose-Pehrsson et al. | 364/497 |
| 5,539,704 | 7/1996 | Doyen et al. | 367/73 |
| 5,659,135 | 8/1997 | Cacas | 73/152.02 |
| 5,699,246 | 12/1997 | Plasek et al. | 364/422 |
| 5,730,234 | 3/1998 | Putot | 175/50 |

*Primary Examiner*—Hezron Williams
*Assistant Examiner*—David J. Wiggins
*Attorney, Agent, or Firm*—Peter Y. Lee; Wayne I. Kanak

[57] ABSTRACT

This invention describes methods and apparatus for identifying potentially hazardous events during the drilling or production of hydrocarbon reservoirs where such events include kick detection in a well, fluid influx from a drilled formation, sticking pipe in a borehole, pipe washouts or formation fracture generation, according to measurements made by instruments such as flowmeter paddles, electrochemical transducers or MWD parameter sensors. Measured signals are compared to a number of possible signals and the probability for said measured signals representing such an event are determined.

11 Claims, 2 Drawing Sheets

ALARM SYSTEM FOR WELLBORE SITE

BACKGROUND OF THE INVENTION

1. Field of the Invention

The present invention relates to an improved method and apparatus for automated detection of events which are either hazardous and/or have important consequences for the drilling or production process of hydrocarbon reservoirs and in particular to provide rapid generation of real-time alarms with a low false alarm rate. Specifically it pertains to a drilling information system which interprets a range of surface and downhole measurements so as to detect hazardous events during the drilling process.

2. Description of the Related Art

Over the last few years, an important improvement to drilling rig instrumentation has been the introduction of "intelligent" systems, which automatically monitor key measurements on the rig and give early, real-time indications of events which are either hazardous and/or have important consequences for the drilling process. These events include, but are not limited to, the early detection of a kick, or influx from the formation being drilled, pipe washouts, fluid loss from the well being drilled and sticking pipe.

Kicks are traditionally detected by monitoring pit volumes and by comparison of flow-in and flow-out of the well being drilled. Monitoring trends in delta-flow has been shown to be particularly successful for early influx detection, as detailed in "Delta Flow: An Accurate, Reliable System for Detecting Kicks and Loss of Circulation During Drilling", J. M. Speers and G. F. Gehrig, SPE/IADC 13496.

Conventional rig instrumentation relies on low-resolution gauges which prevent trends from being readily identified. A simple alarm can be raised when the flow out or the pit volume exceeds a preset value, but to avoid continuous false alarms the preset value is generally set high, allowing small influxes to go unnoticed.

While existing computer systems can provide much more sensitive and reliable indicators during the early stages of events such as kicks, there are still many limitations.

For example, previous computerized systems have typically used the Hinkley algorithm as detailed in "Inference About the Change-Point from Cumulative Sum Tests", D. V. Hinkley, Biometrika 42(6), pp 1897–1908, 1971 in order to detect trends in the data channel(s) being monitored. The algorithm is, however, optimized for the detection of step changes. The algorithm is used to detect a linear trend by approximating the trend as a sequence of steps. This technique is therefore not optimal for the detection of events such as kicks and washouts as these have functional forms which are poorly approximated by a sequence of step changes. In particular, when using the known approach, the operator still needs to set a sensitivity parameter to correctly balance the trade-off between the detector's sensitivity and the number of false alarms. While it is easy to reduce the sensitivity of the systems if false alarms occur, it is less obvious when to increase the sensitivity again, unless an event is already in progress. The best sensitivity setting varies depending on measurement noise, which may be caused by rig motion on a floating rig or large cuttings interfering with correct operation of the flow sensor. The operation of the system therefore needs to be closely monitored..

A method for modeling the probability of a drill string becoming stuck is described in the U.S. Pat. No. 5,508,915. In this method, a canonical point representation of the drilling process is derived from borehole measurements and drilling parameters. The point is mapped into a canonical space to indicate the probability of sticking.

Further there are known mathematical methods, such as the Bayesian theory, which allow to discern different hypotheses when given experimental evidence (data). The Bayesian theory has been attributed to Rev. Thomas Bayes, who first discovered its principles back in 1763. A modern summary of Bayesian theory is presented for example by E. T. Jaynes, in an article titled "Confidence Intervals versus Bayesian Intervals", which is published in: "Papers on Probability, Statistics and Statistical Physics", R. D. Rosenkrantz (Ed.), Kluwer, 1983, pp. 149–209.

In view of the above cited prior art it is an object of the invention to provide an alarm system to detect events with greater sensitivity than known systems. It is a particular object of the invention to provide such a system for which requires less or no human intervention for setting sensitivity or threshold values.

SUMMARY OF THE INVENTION

The objects of the invention are achieved by apparatus and methods as set forth in the appended claims.

A detection system for detecting potentially hazardous subterranean events in accordance with the invention comprises

- means for receiving a signal representing a surface and/or downhole measurement;
- means for generating a plurality of possible signals representing potentially hazardous subterranean events;
- means for selecting from said plurality of possible signals the signal with a highest probability of representing the received signal; and
- means for generating a visible and/or audible signal if said highest probability exceeds a predetermined threshold.

As mentioned above, hazardous subterranean events include kicks, or influx from the formation being drilled, pipe washouts, fluid loss from the well being drilled and sticking pipes, or failure of the bottom hole assembly, in particular of the drilling motor.

Measurements concern all parameters which provide information usable for predicting a potentially hazardous event.

Hence, suitable surface measurements include delta flow measurements, measurements concerning filling levels or surface fluid retention tanks, hookload and stand pipe pressure measurements.

Suitable downhole measurements include rotational speed of the drilling motor or other known MWD (measurement-while-drilling) parameters, such as tool orientation, downhole flow-rate measurements, or gamma-ray measurements.

Possible signals can be all or a subset of those signals which are expected to be received from performing surface and downhole measurements. Preferably, they include signals in the presence of an event as well as signals which could generate false alarms due to normal drilling rig activities. It is within the scope of the present invention to replace the measured signals by signals derived therefrom, such as time derivatives, sum, products etc.

The plurality of possible signals which are compared with the transmitted signal are preferably stored in a memory or generated on-the-fly. Preference of either method depends on the available equipment. The possible signals are generated using prior knowledge of the data transmitted and the distorting characteristics, or more generally, of the transfer function of the transmission channel. Given the transfer function and the data, the possible analog representations as are required for the present invention are generated by a convolution process. In the modeling process, engineering experience and available knowledge of the events is utilized.

The comparison between received signal and the possible signals, and the selection of the most probable of those possible signals is preferably based on a mathematical method named after Thomas Bayes. The present invention seeks to include all mathematical equivalents of this method as different notations, formulations, and presentation, thereof, appear in the relevant literature.

The invention provides a new alarm system to detect events with greater sensitivity than previous systems. It largely removes the requirement for human intervention to set a sensitivity value. The use of prior knowledge and accurate models of the event being detected provides an advantage over the known systems. The current invention further optimizes the trade-off between detection sensitivity and false alarm rate, requiring no operator intervention. It can detect alarms in real-time, i.e. on a time scale by which rapid, appropriate operator intervention is possible.

In a preferred embodiment, the invention computes and displays real-time probability information which indicates the probability of an on-going kick or other event. This provides the system operator with quantitative evidence on which to base a decision for further action. Also, the time history of the probability information provides additional information on the evolution and seriousness of the event.

To fully appreciate the invention, it should be noted that the described process is performed in the analog domain, i.e., before individual parts (bits) of data have been identified. As a matter of course, the term "analog" as used throughout this description also includes a digitized representation, as resulting for example from an analog-digital conversion (ADC), of the transmitted or measured signals, These and other features of the invention, preferred embodiments and variants thereof, and advantages will become appreciated and understood by those skilled in the art from the detailed description and drawings following hereinafter.

DETAILED DESCRIPTION OF THE INVENTION

The invention is described with reference to the detection of kicks and stalling of a downhole motor, but the other types of event detection can be implemented by using a combination of different measurements and signal models.

Figure 1:
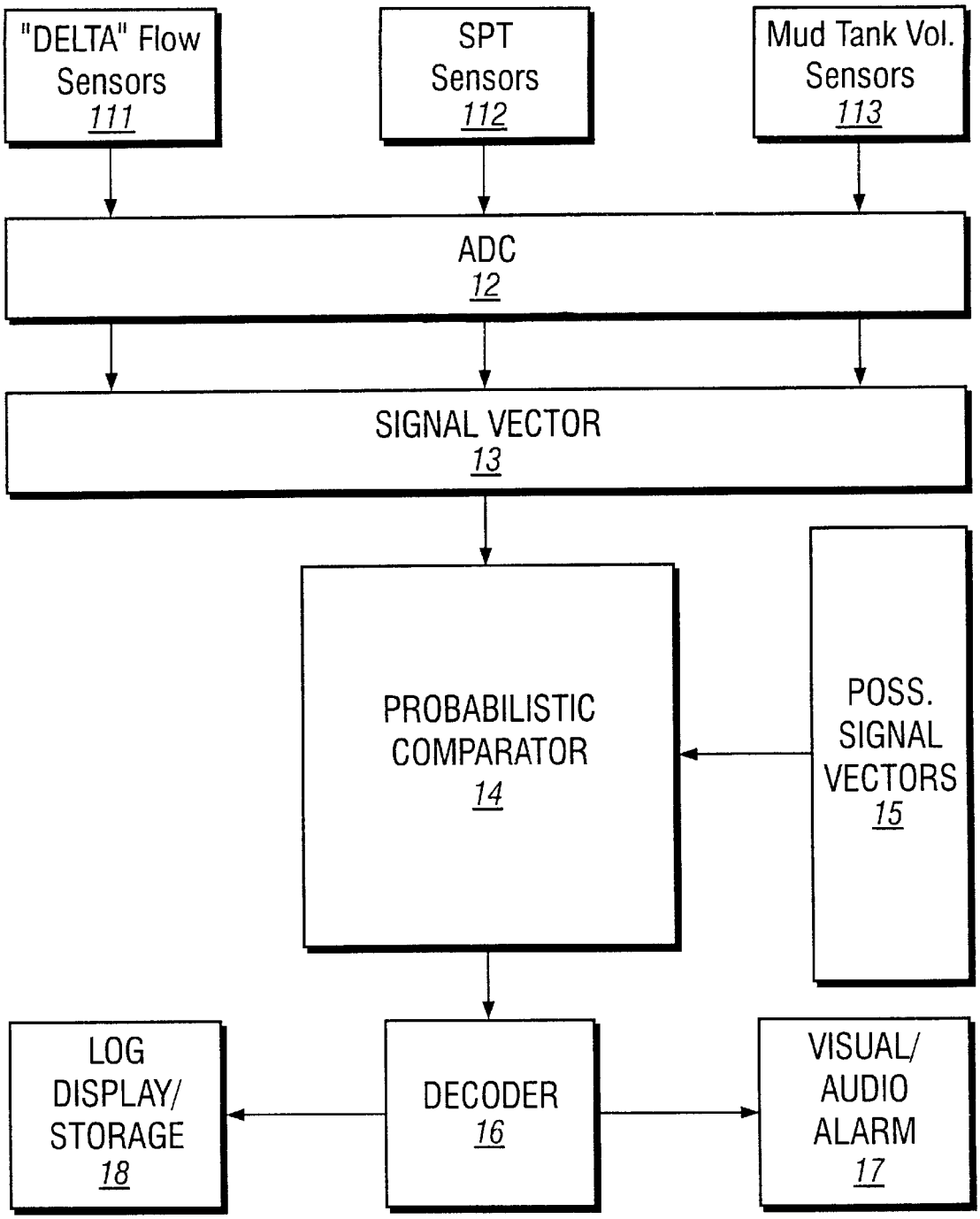
FIG. 1 illustrates major functional blocks of an event detection system in accordance with the present invention.

Before describing the new features of an example with reference to the block diagram shown in FIG. 1, important formulas of the Bayesian theory are shortly summarized. Given some data D, and a model M, the basic theorem of Bayes states $$\Pr(M \mid D) = \frac{\Pr(D \mid M)\Pr(M)}{\Pr(D)} \qquad [1]$$

The quantity of interest is Pr (MID), known as the posterior probability of the model M in light of the data D, Pr (D|M) is the likelihood of the data given the model, Pr (M) is the prior probability of the model. The latter represents the prior belief in the chosen model. The denominator Pr (D) is a normalization term that has the same value for different models applied to the same data. This means that the relative probability of different models on the same data could be found without finding an absolute value for Pr (D). This is conditional, however, on evaluating the likelihood Pr (D|M). The Bayesian approach treats this problem as another application of Bayes' rule :

$$\Pr(\mu, \sigma, \mid D, M) = \frac{\Pr(D \mid \mu, \sigma, M)\Pr(\mu, \sigma \mid M)}{\Pr(D \mid M)} \qquad [2]$$

Equation 2 gives the posterior probability of the model parameters (in the example: the mean $\mu$ and the variance $\sigma$, respectively, of a Gaussian model) as a function of the data likelihood, a prior for the parameters, and a normalizing constant. The likelihood can be explicitly evaluated given values for $\mu$ and $\sigma$. The prior is a joint probability distribution over the two parameters given the chosen model assumption. The normalization term is the quantity of interest in equation 1. The normalization term can be extracted from equation [2] by integrating the left hand side over all possible values of the model parameters. Integrating a distribution over all possible events gives unity, and since the denominator is independent of $\mu$ and $\sigma$, the value of Pr (D|M) can be determined by $$\Pr(D \mid M) = \int_{\mu,\sigma} \Pr(D \mid \mu, \sigma, M)\Pr(\mu, \sigma \mid M) \qquad [3]$$

Thus equation [3] gives the term required in equation 1. This procedure is known as integrating out nuisance parameters, and is one of the features of Bayesian statistics. The difficulty of the integration depends on the form of the prior. If the models are Gaussian, the integration is usually analytically tractable. Monte-Carlo numerical solutions have been used for other cases. In some situations, the integration can be approximated closely enough by summing probabilities of discrete models. The latter variant is used in this embodiment to determine the denominator and, hence, the evidence, following an approach described as such for example by D. MacKay in: Neural Computation, Vol. 4(1992), No. 3, pp.415–472, and no. 5, pp.698–714.

Referring now to the example schematically depicted by FIG. 1, the analog signals from the data channels to be analyzed are detected, decoded and converted into meaningful data by a suitable signal detector.

For the illustrated kick detection, means 111 for measuring flow into and out of the well being drilled are the minimum measurements required. The flow into the well is determined by measurement of the stroke rate of a pump with a given cylinder or pumping volume. The flow out of the borehole is measured by using a flow paddle. Other applicable flow detectors are available in the art, based for example on optical or electrical sensors.

Though in principle the measurement of the "delta" flow suffice, the kick detection prediction can be improved by performing additional measurements. In the example additional pressure measurements 112 are made employing an electro-mechanical transducer which is generally known in the art as SPT (Stand-pipe Pressure Transducer) and sensors 113 for monitoring mud tank volumes.

The analog signal of the transducer is appropriately filtered and sampled at an appropriate frequency by an AD converter 12 to derive a digitally coded representation of the analog signal, which then can be farther processed as described in the following.

The digitized analog signals are stored in a buffer 13 which collects data to form a signal vector comprising the in flow measurement, the delta flow as calculated from the measured IN and OUT flow, the standpipe pressure measurement and the tank volume over a time period of 5 minutes equivalent to 300 data points. The length of the vector may be increased so as to capture very slow influx from the formation.

The signal vector enters as input to a probabilistic comparator 14 which calculates the likelihood or probability of a model vector to represent the actual data vector. The comparator refers to a database 15 which stores pre-calculated representations of possible data vectors which in turn can by assigned to alarm scenarios.

The output of the probabilistic comparator is, a vector of calculated probabilities associated with the tested possible data vectors. A decoder 16 evaluates the probabilities of measurement data and thereafter selects the most likely representation of the detected signal. If there is a high computed probability, say greater than 0.9 that the likely representation of the detected signal represents a kick, than an alarm 17 is raised in order to attract the attention of the relevant personnel. Also, a log 18 displays real-time probability information which indicates the probability of an on-going kick or other events. This provides the relevant personnel with quantitative evidence on which to base a decision for further action.

The probabilistic comparator 14 of FIG. 1 generates a vector comprising the normalized posterior probabilities for all possible data vectors or models by a process comprising the steps of:

1. Calculating the residuals between a model, data and the signal data along the length of the vector, where the kth element $r_k$ of the residual vector r is the difference between the model and the signal for sample k.
2. Assuming the residuals form a Gaussian distribution with zero mean, the variance of this distribution is calculated according to $$\sigma^2 = \max\left(\frac{r^T r}{n-1}, \sigma_l^2\right) \quad [4]$$

with n denoting the number of samples or elements in the model and signal data vector and the corresponding residual vector, multiplied by an oversampling factor (Fs/2*Fc), where Fs is the sampling frequency and Fc is the cut-off frequency of the filtered signal. A lower bound $s_1^2$ is introduced to avoid taking a logarithm of zero. The larger the size of this lower boundary is chosen, the larger is the likelihood of the best fit model when the noise is insignificant. Suitable values for $s_1^2$ are $10^{-10}$ or $10^{-20}$ both of which are indistinguishable for data sampled at 1 Hz when looking for kick events.

Given $s_1^2$ the logarithm l of the likelihood for the data, given the model is calculated by $$l = -\frac{n}{2}\log(2\pi\sigma^2) - \frac{n-1}{2} \quad [5]$$

The calculation is simplified because the variance of the distribution is set at the sample variance of the data. The residue between the signal data and the possible data model enters the likelihood through the variance.

This calculation process is extended to parts, sub-groups, channels, and the like, of the signal, in which case the likelihood of the complete data model is given by the product of the likelihood for each part, sub-group, channel etc.

To generate from the likelihoods for each of the possible data vector a vector which contains the normalized Bayesian posterior probability (cf. eq. [1]) following steps are performed:

1. Generating a logarithmic likelihood vector 1, where the kth element is the logarithmic likelihood of a model k as calculated in accordance with eq.[4] and [5].
2. Scaling the logarithmic likelihood vector 1 to form a scaled logarithmic likelihood vector $\mathbf{1}_s$ by $$l_s = l - max(l) \otimes \quad [6]$$

where max(l) is the maximum of the elements of l.

3. Evaluating the un-normalized posterior probability by $$Pr_u = exp(l_s) Pr(M) \quad [7]$$

where Pr(M) is a vector of the normalized prior probabilities of the model data such that the kth element of Pr(M) is the normalized prior probability of the model k (in this example all models have the same prior probability), $\otimes$ denotes an element-wise multiplication operator and expo is an element-wise exponentiation operator.

4. To generate a vector Pr containing the normalized posterior probabilities, the vector $Pr_u$ is divided by the scalar sum of its elements:

$$Pr = \frac{Pr_u}{\sum_k Pr_u}. \quad [8]$$

It will be appreciated by those skilled in the art that the above described method of evaluating the posterior probability by using scaled vectors and calculating with logarithms avoids divisions by zero and significantly reduce's the number and complexity of computational operations. However, it is obviously possible to calculate the posterior probabilities using for example the actual values for the Gaussian model in place of their logarithms. The Gaussian model for the distribution of the residues further constitutes a particularly advantageous model, other known or even specifically designed models for the distribution could be applied.

Figure 2:
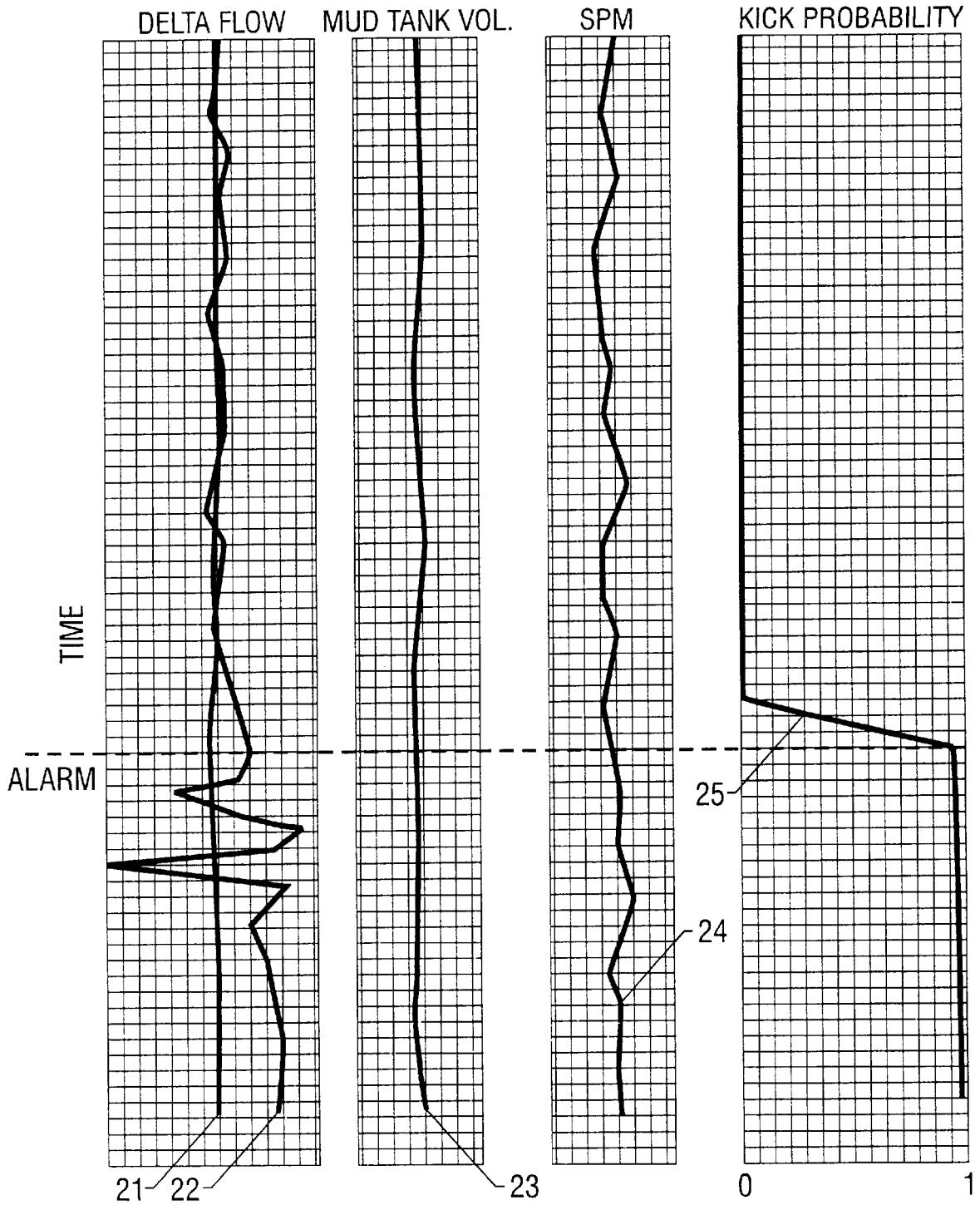
FIG. 2 shows log information as generated by using an embodiment of the present invention.

In FIG. 2, a log is shown displaying the measured values of the IN flow 21, the OUT flow 22, the mud tank volume 23, and the standpipe pressure 24 during a period of approximately 10 minutes. Also shown is a graph 25 which represents the calculated probability for a kick event. The time 26 at which a kick alarm is triggered is indicated by a dashed horizontal line through the log data.

The "kick probability" on the log on the right shows how confident the system is in the alarm and how this confidence varies with time. When the data contains a lot of noise, the track could reach 100% and then fall back rapidly, or it could hover around 50%. Such occurrences might indicate that the flow data is ambiguous, and that the channels should be monitored carefully for further evidence of a kick. If, on the other hand, the log rises to 100% (as in FIG. 2) and stays there, then there is strong evidence of a kick.

The technique allows accurate and robust indication of the kick event at very low influx volume—even when operating under the noisy conditions which are often experienced on a floating rig. The probability log quantifies the probability that there is an on-going kick event and provides the time history of that probability. This provides valuable quantitative evidence on which to base a decision for further action.

As a further extension of the technique, an underlying quantity such as the volume of fluid influx from the formation in the borehole during a kick might be computed and displayed. Computation of this quantity can be done using the probabilities and the models described above, as follows. Each kick model has a defined influx volume. The product of a model's influx volume and its probability gives the expected influx volume for that model. Summing the expected influx volumes over the model set, using normalized probabilities, gives the inferred influx volume. This gives a real-time indication of an inferred measurement (the influx volume, which is not directly measurable in the sense that pump strokes or the deflection of a flow paddle are directly measurable). This and other inferred properties of data might be computed using expectation operations from model probabilities.

In a further example of the present invention, an alarm is generated when there is a risk of motor stalling in a bottom hole assembly (BHA) during the drilling process. In this example, the signal vector is composed of three measurements: an RPM measurement monitoring the rotational velocity of the motor, a hookload measurement and a standpipe pressure measurement. Whereas the latter two measurements are performed on the surface, the former is made at the BHA, appropriately coded and transmitted to the surface by a known mud pulse system or any other suitable telemetry device for transmitting data from subterranean location to the surface.

As in the first example, additional measurements, i.e., the SPT measurement and the hookload measurement, are included in the signal vector to avoid misinterpretation of the RPM signal. The following steps of the example are identical to those of the first example, given that the database of possible signal vectors are loaded with a different set of possible signal vectors.

The examples clearly demonstrate that the probabilistic comparator in accordance with the present invention provides a versatile apparatus and method adaptable to a large variety of possible events in a wellbore.

We claim:

1. A detection system for detecting potentially hazardous drilling conditions in terms of a set of drilling operation parameters that can be related to subterranean events, said system comprising:

a monitoring system adapted to monitor drilling operation parameters representing at least part of the status of a hydrocarbon drilling operation;

a buffer for storing the monitored drilling operation parameters as a time series;

a time series generator adapted and configured to generate a plurality of possible time series of drilling operation parameters, said generated time series representing potential values for said monitored drilling operation parameters, wherein at least some of said generated time series being associated with potentially hazardous drilling conditions;

a normalizer adapted to compensate for differences between said stored time series of monitored drilling operation parameters from said buffer and said generated time series from said time series generator;

a comparator adapted to compare said stored time series of said monitored drilling operation parameters with said plurality of generated time series to calculate a set of residual values;

a probability calculator adapted and configured to create a normalized probability value for each generated time series by utilizing the calculated residual values, said probability value being the probability that the generated time series represents the stored monitored time series; and an alarm indicator adapted to generate a visible and/or audible signal if a resultant probability based on said probability values exceeds a predetermined threshold regarded to be indicative of a potentially hazardous drilling condition.

2. The detection system of claim 1, wherein said probability calculator uses a Bayesian based method for determining the probability value.

3. The detection system of claim 1, wherein said probability calculator determines for at least one of the generated time series the probability of representing the stored time series, wherein a predetermined probability distribution is used to model the noise on the monitored drilling operation parameters given that at least one of said monitored parameters has been transmitted.

4. The detection system of claim 1, wherein the time series generator comprises means for storing and retrieving said plurality of possible time series, means for generating a possible time series on-the-fly, or a combination thereof.

5. The detection system of claim 1, further comprising means to display information related to the probability of at least one of the generated time series.

6. A Detection system for detecting a sudden influx into a borehole from a subterranean formation in terms of a set of drilling operation parameters known relateable to a borehole'status, said system comprising:

a receiver adapted to receive drilling operation parameters representing the status of influx into a borehole from a subterranean formation;

a buffer for storing the measured drilling operation parameters as a time series;

a time series generator adapted and configured to generate a plurality of possible time series of drilling operation parameters, said generated time series representing influx into a borehole from a subterranean formation;

a normalizer adapted to compensate for differences between said stored time series of drilling operation parameters from said buffer and said generated time series from said time series generator;

a comparator adapted to compare said stored time series of said received drilling operation parameters with said plurality of generated time series to calculate a set of residual values;

a probability calculator adapted and configured to create a normalized probability value for each generated time series by utilizing the calculated residual values, said probability value being the probability that the generated time series represents the stored time series from the buffer; and an alarm indicator adapted to generate a visible and/or audible signal if a resultant probability based on said probability values exceeds a predetermined threshold regarded to be indicative of a potentially hazardous drilling condition.

7. The detection system of claim 6, wherein said probability calculator uses a Baysian based method for determining the probability value.

8. A Method for detecting potentially hazardous drilling conditions in terms of a set of drilling operation parameters that can be related to subterranean events and a nell's status, said method comprising the steps of:

receiving drilling operation parameters representing at least part of the status of a hydrocarbon drilling operation;

storing the received drilling operation parameters as a time series;

generating a plurality of possible time series representing potential values for said received drilling operation parameters, wherein at least some of said generated time series being associated with potentially hazardous drilling conditions;

normalizing to compensate for differences between said stored time series of received drilling operation parameters from said buffer and said generated time series from said time series generator comparing said stored time series of said received drilling operation parameters with said plurality of generated time series to calculate a set of residual values calculating a probability value for each generated time series by utilizing the calculated residual values, said probability value being the probability that the generated time series represents the stored received time series; and generating a visible and/or audible signal if a resultant probability based on said probability values exceeds a predetermined threshold regarded to be indicative of a potentially hazardous drilling condition.

9. The method of claim 7, wherein said step of calculating a probability value comprises using a Baysian based method for determining the probability value.

10. A Method for detecting a sudden influx into a borehole from a subterranean formation in terms of a set of drilling operation parameters known relateable to a borehole's status, said method comprising the steps of:

monitoring drilling operation parameters representing the status of influx into a borehole from a subterranean formation;

storing the monitored drilling operation parameters as a time series in a buffer;

generating a plurality of possible time series of drilling operation parameters representing potential values for said monitored drilling operation parameters, wherein at least some of said generated time series are associated with influx into a borehole from a subterranean formation;

normalizing to compensate for differences between said stored time series of monitored drilling operation parameters from said buffer and said generated time series from said time series generator;

comparing said stored time series of said monitored drilling operation parameters with said plurality of generated times series to calculate a set of residual values;

calculating a normalized probability value for each generated time series by utilizing the calculated residual values, said probability value being the probability that the generated time series represents the stored monitored time series; and generating a visible and/or audible signal if a resultant probability based on said probability values exceeds a predetermined threshold regarded to be indicative of a potentially hazardous drilling condition.

11. The method of claim 8, wherein said step of calculating a normalized probability value comprises using a Baysian based method for determining the probability value.

* * * * *